US005826566A

United States Patent [19]

Isobe et al.

[11] Patent Number: 5,826,566

[45] Date of Patent: Oct. 27, 1998

[54] EVAPORATIVE FUEL-PROCESSING SYSTEM FOR INTERNAL COMBUSTION ENGINES

[75] Inventors: Takashi Isobe; Takashi Yamaguchi, both of Wako, Japan

[73] Assignee: Honda Giken Kogyo Kabushiki Kaisha, Tokyo, Japan

[21] Appl. No.: 881,504

[22] Filed: Jun. 24, 1997

[30] Foreign Application Priority Data

Jul. 26, 1996 [JP] Japan ..... 8-214116

[51] Int. Cl.[6] ..... F02M 33/02

[52] U.S. Cl. ..... 123/520

[58] Field of Search ..... 123/518, 519, 123/520, 198 D

[56] References Cited

U.S. PATENT DOCUMENTS 5,263,462 11/1993 Reddy ..... 123/520

5,425,344 6/1995 Otsuka et al ..... 123/520

FOREIGN PATENT DOCUMENTS 7-12016 1/1995 Japan .

*Primary Examiner*—Thomas N. Moulis

*Attorney, Agent, or Firm*—Nikaido, Marmelstein, Murray & Oram LLP

[57] ABSTRACT

An evaporative fuel-processing system for an internal combustion engine includes an evaporative emission control system having a canister for adsorbing evaporative fuel generated in the fuel tank, a passage extending between the fuel tank and the canister, a pressure-regulating valve arranged across the passage, for regulating pressure within the fuel tank to a predetermined value, and a pressure sensor for detecting pressure within the fuel tank. It is determined whether or not the evaporative emission control system is abnormal, based on the detected pressure within the fuel tank over a predetermined time period after starting of the engine. The predetermined time period is changed based on a parameter representative of the temperature of the fuel tank assumed at starting of the engine.

5 Claims, 12 Drawing Sheets

EVAPORATIVE FUEL-PROCESSING SYSTEM FOR INTERNAL COMBUSTION ENGINES

BACKGROUND OF THE INVENTION

1. Field of the Invention

This invention relates to an evaporative fuel-processing system for internal combustion engines, for purging evaporative fuel generated in the fuel tank into the intake system of the engine, and more particularly to an evaporative fuel-processing system which is capable of detecting abnormality of an evaporative emission control system thereof.

2. Prior Art

Conventionally, an evaporative fuel-processing system for internal combustion engines has been widely used, which includes an evaporative emission control system comprised of a canister for adsorbing evaporative fuel generated in a fuel tank of the engine, a passage extending between the canister and the intake system of the engine, and a purge control valve arranged across the passage, for controlling purging of evaporative fuel adsorbed in the canister into the intake system. Further, a method of detecting abnormality of the evaporative emission control system of this type has been proposed, e.g. by Japanese Laid-Open Patent Publication (Kokai) No. 7-12016 and U.S. Pat. No. 5,427,075 corresponding thereto.

According to the above proposed method, an amount of change in the pressure within the fuel tank (hereinafter referred to as "the tank internal pressure") is monitored over a predetermined time period after the start of the engine, and when the amount of change in the tank internal pressure falls within a predetermined range while the tank internal pressure is equal to or close to the atmospheric pressure, it is determined that the evaporative emission control system is abnormal (evaporative fuel leaks from the evaporative emission control system).

The above proposed abnormality-determining method, however, has the following inconvenience: That is, when the engine is idling or operating in a low load condition in an environment of low outside air temperature, the rising speed of temperature in the fuel tank is slow and accordingly the change in the tank internal pressure is extremely small. As a result, even when there is no leakage of evaporative fuel from the evaporative emission control system, an erroneous determination can be made that the evaporative emission control system is abnormal.

SUMMARY OF THE INVENTION

It is the object of the invention to provide an evaporative fuel-processing system for internal combustion engines, which is capable of accurately determining the presence of abnormality in the evaporative emission control system even in an environment in which the amount of change in the tank internal pressure is small.

To attain the above object, according to a first aspect of the invention, there is provided an evaporative fuel-processing system for an internal combustion engine having a fuel tank, including an evaporative emission control system having a canister for adsorbing evaporative fuel generated in the fuel tank, a passage extending between the fuel tank and the canister, a pressure-regulating valve arranged across the passage, for regulating pressure within the fuel tank to a predetermined value, and pressure-detecting means for detecting pressure within the fuel tank, and abnormality-determining means for determining whether the evaporative emission control system is abnormal, based on the pressure within the fuel tank detected by the pressure-detecting means over a predetermined time period after starting of the engine.

The evaporative fuel-processing system according to the first aspect is characterized by an improvement wherein:

the abnormality-determining means includes changing means for changing the predetermined time period, based on a parameter representative of temperature of the fuel tank assumed at starting of the engine.

Preferably, the abnormality-determining means sets the predetermined time period to a larger value as the parameter indicates a lower value of the temperature of the fuel tank.

Preferably, the parameter is representative of temperature of the engine.

Alternatively, the parameter is representative of ambient temperature of the engine.

In a preferred embodiment of the invention, the abnormality-determining means includes sampling time-setting means for setting a number of times of sampling of the pressure within the fuel tank, the sampling time-setting means setting the number of times of sampling to a larger value as the parameter indicates a lower value of the temperature of the fuel tank, the abnormality-determining means setting the predetermined time period, according to the number of times of sampling set by the sampling time-setting means.

Preferably, the abnormality-determining means determines that the evaporative emission control system is abnormal when an average value of the detected pressure within the fuel tank falls within a range between a predetermined negative pressure value and a predetermined positive pressure value and at the same time a difference between a maximum value and a minimum value of the detected pressure within the fuel tank is smaller than a predetermined value.

To attain the object, according to a second aspect of the invention, there is provided an evaporative fuel-processing system for an internal combustion engine having a fuel tank, the engine being installed in a vehicle, the evaporative fuel-processing system including an evaporative emission control system having a canister for adsorbing evaporative fuel generated in the fuel tank, a passage extending between the fuel tank and the canister, a pressure-regulating valve arranged across the passage, for regulating pressure within the fuel tank to a predetermined value, and pressure-detecting means for detecting pressure within the fuel tank, and abnormality-determining means for determining whether the evaporative emission control system is abnormal, based on the pressure within the fuel tank detected by the pressure-detecting means over a predetermined time period after starting of the engine.

The evaporative fuel-processing system according to the second aspect is characterized by an improvement wherein:

the abnormality-determining means executes abnormality determination of the evaporative emission control system when a traveling distance of the vehicle assumed after starting of the engine exceeds a predetermined value.

To attain the object, according to a third aspect of the invention, there is provided an evaporative fuel-processing system for an internal combustion engine having the same preamble portion as that in the first aspect.

The evaporative fuel-processing system according to the third aspect is characterized by an improvement wherein:

the abnormality-determining means determines whether the evaporative emission control system is abnormal, by comparing a value corresponding to the pressure within the fuel tank detected by the pressure-detecting means, with a predetermined reference value set based on a parameter representative of temperature of the fuel tank.

Preferably, the predetermined negative pressure value is set to a larger value as the parameter indicates a lower value of the temperature of the fuel tank, and the predetermined positive pressure value is set to a smaller value as the parameter indicates a lower value of the temperature of the fuel tank.

Also preferably, the difference is set to a larger value as the parameter indicates a lower value of the temperature of the fuel tank.

The above and other objects, features and advantages of the invention will be more apparent from the following detailed description taken in conjunction with the accompanying drawings.

DETAILED DESCRIPTION

The invention will be described in detail with reference to the drawings showing embodiments thereof.

Figure 1:
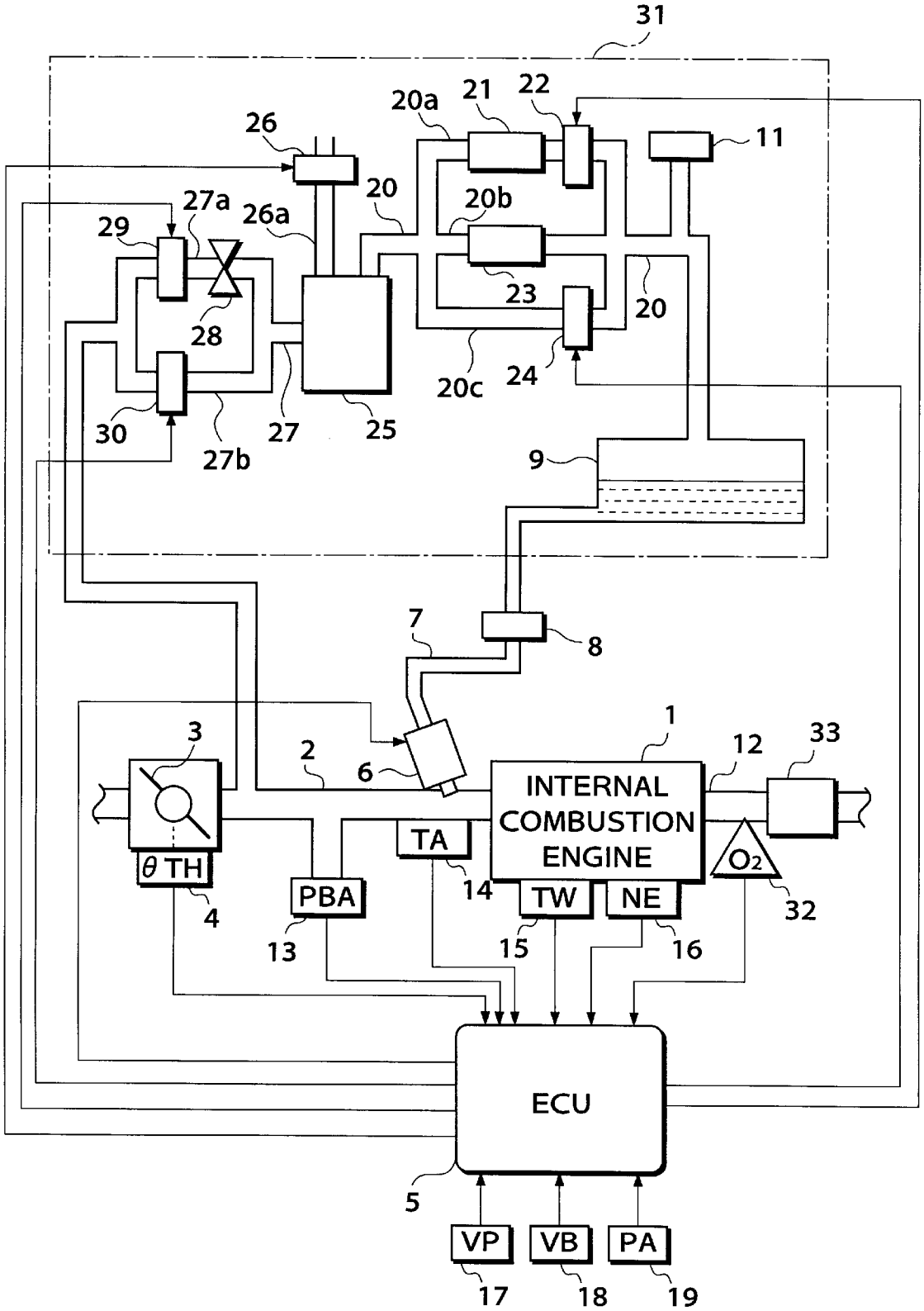
FIG. 1 is a block diagram showing the whole arrangement of an internal combustion engine and an evaporative fuel-processing system therefor, according to a first embodiment of the invention.

Referring first to FIG. 1, there is shown the whole arrangement of an internal combustion engine and an evaporative fuel-processing system therefor, according to a first embodiment of the invention.

In the figure, reference numeral 1 designates an internal combustion engine (hereinafter simply referred to as "the engine") having four cylinders, for instance. Arranged in an intake pipe 2 of the engine 1 is a throttle valve 3. A throttle valve opening (θTH) sensor 4 is connected to the throttle valve 3, for generating an electric signal indicative of the sensed throttle valve opening and supplying the same to an electronic control unit (hereinafter referred to as "the ECU") 5.

Fuel injection valves 6, only one of which is shown, are inserted into the interior of the intake pipe 2 at locations intermediate between the cylinder block of the engine 1 and the throttle valve 3 and slightly upstream of respective intake valves, not shown. Each of the fuel injection valves 6 is connected to a fuel tank 9 via a fuel supply pipe 7 across which a fuel pump 8 is provided. The fuel injection valves 6 are electrically connected to the ECU 5 to have their valve opening periods controlled by signals therefrom.

Mounted downstream of the throttle valve 3 of the intake pipe 2 are an intake pipe absolute pressure (PBA) sensor 13 for detecting absolute pressure PBA within the intake pipe 2 and an intake air temperature (TA) sensor 14 for detecting the temperature TA of intake air supplied to the engine 1. Signals indicative of the detected values thereof are supplied to the ECU 5.

An engine coolant temperature (TW) sensor 15 formed of a thermistor or the like is inserted into a coolant passage filled with a coolant and formed in the cylinder block of the engine 1, for detecting the temperature of the coolant and supplying an electric signal indicative of the sensed engine coolant temperature TW to the ECU 5.

An engine rotational speed (NE) sensor 16 is arranged in facing relation to a camshaft or a crankshaft of the engine 1, neither of which is shown.

The NE sensor 16 generates a signal pulse as a TDC signal pulse at each of predetermined crank angles whenever the crankshaft rotates through 180 degrees, the TDC signal pulse being supplied to the ECU 5.

An O2 sensor 32 as an exhaust gas component concentration sensor is arranged in an exhaust pipe 12 of the engine 1, for detecting the concentration of oxygen in exhaust gases from the engine 1 and supplying a signal indicative of voltage VO2 proportional to the detected concentration of oxygen to the ECU 5. A three-way catalyst 33 as an exhaust gas-purifying device is arranged in the exhaust pipe 12 at a location downstream of the O2 sensor 32.

Connected to the ECU 5 are a vehicle speed sensor 17 for detecting the traveling speed VP of a vehicle with the engine 1 installed therein, a battery voltage sensor 18 for detecting battery voltage VB, and an atmospheric pressure sensor 19 for detecting the atmospheric pressure PA, the signals indicative of the detected values being supplied to the ECU 5.

Next, an evaporative emission control system (hereinafter referred to as "the emission control system") will be described, which includes a fuel tank 9, a charging passage 20, a canister 25, a purging passage 27, etc.

The fuel tank 9 is connected to the canister 25 via the charging passage 20 which has first to third divided passages **20*a* to 20*c*. A tank internal pressure sensor 11 as pressure-detecting means is arranged in the charging passage 20 at a location intermediate between the divided passages 20*a* to 20*c* and the fuel tank 9, for detecting tank internal pressure PTANK and supplying a signal indicative of the detected tank internal pressure PTANK to the ECU 5**.

Inserted into the first divided passage **20*a* are a one-way valve 21 and a puff loss valve 22. The one-way valve 21 is constructed so as to open only when the tank internal pressure PTANK is higher than the atmospheric pressure by about 5 mmHg or more. The puff loss valve 22 is an electromagnetic valve which is kept open during purging, as described hereinbelow, and is kept closed while the engine is at a stop, the operation thereof being controlled by a signal from the ECU 5**.

Inserted into the second divided passage 20*b* is a two-way valve 23, which is constructed so as to open when the tank internal pressure PTANK is higher than the atmospheric pressure by about 20 mmHg or more and when the tank internal pressure PTANK is lower by 10 mmHg or more than pressure acting on one side of the two-way valve 23 closer to the canister 25.

Inserted into the third divided passage 20*c* is a bypass valve 24, which is formed by an electromagnetic valve of normally-closed type, while it is opened and closed during execution of the abnormality determination, as described hereinbelow, the operation thereof being controlled by a signal from the ECU 5.

The canister 25 accommodates activated carbon for adsorbing evaporative fuel generated in the fuel tank, and is provided with an intake port, not shown, to communicate with the atmosphere via a passage 26*a*. Inserted into the passage 26*a* is a drain shut valve 26 which has its operation controlled by a signal from the ECU 5.

The canister 25 is connected to the intake pipe 2 at a location downstream of the throttle valve 3 via the purging passage 27 which has first and second divided passages 27*a* and 27*b*. Inserted into the first divided passage 27*a* are a jet orifice (restriction) 28 and a jet purge control valve 29, and into the second divided passage 27*b* a purge control valve 30, respectively. The jet purge control valve 29 is formed by an electromagnetic valve and controls an amount of a mixture of air and evaporative fuel to be purged, at such a small flow rate as cannot be precisely controlled by means of the purge control valve 30. The purge control valve 30 is formed by an electromagnetic valve and continuously controls the flow rate of the mixture in response to a change in the on-off duty ratio of a control signal supplied thereto. The operations of these electromagnetic valves 29 and 30 are controlled by the ECU 5.

The ECU 5 is comprised of an input circuit having the functions of shaping the waveforms of input signals from various sensors described above, shifting the voltage levels of sensor output signals to a predetermined level, converting analog signals to digital signals, and so forth, a central processing unit (hereinafter referred to "the CPU"), a memory circuit storing operational programs executed by the CPU and for storing results of calculations therefrom, etc., and an output circuit which outputs driving signals to the fuel injection valves 6, the puff loss valve 22, the bypass valve 24, the jet purge control valve 29 and the purge control valve 30.

Figure 2:
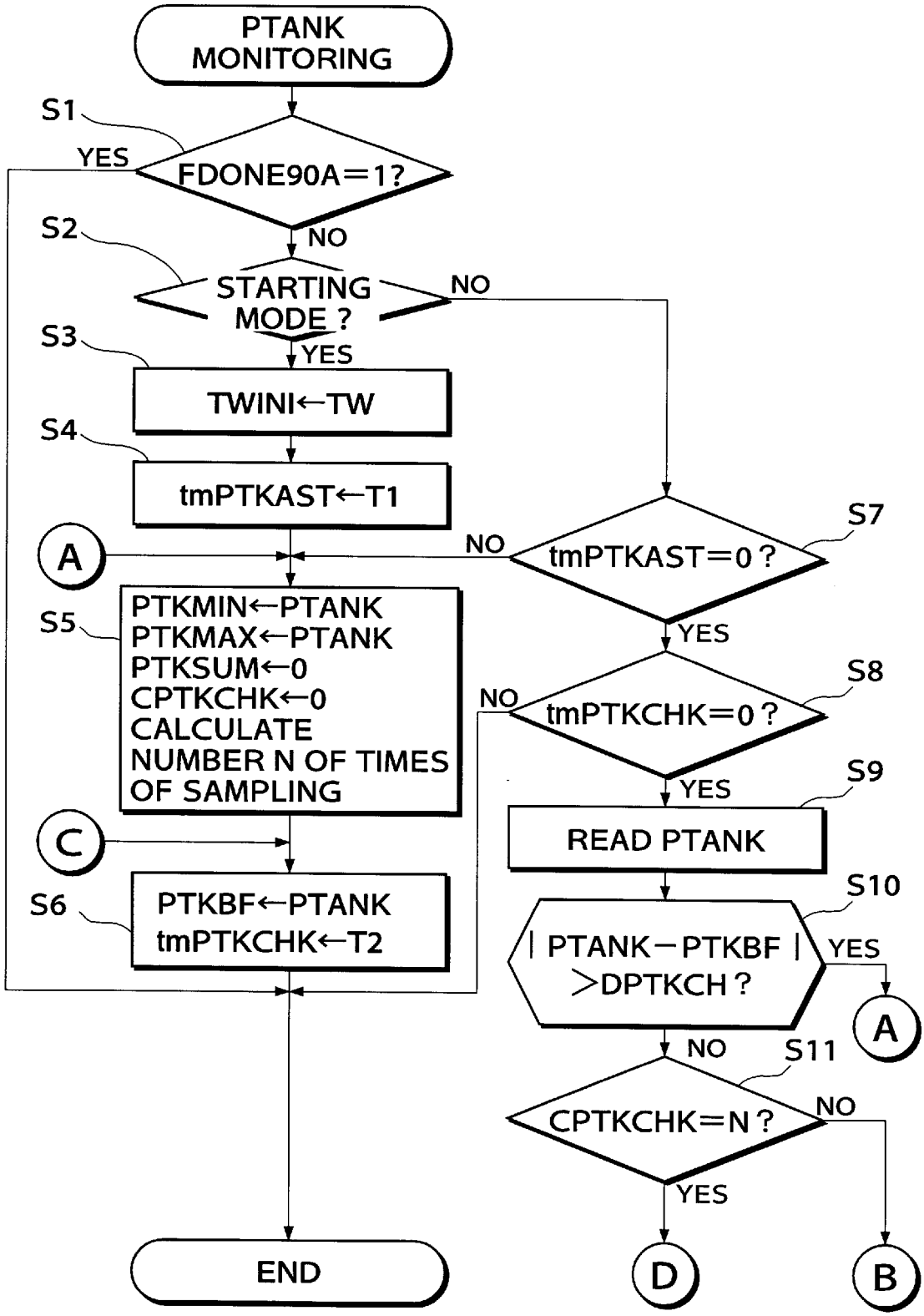
FIG. 2 is a flowchart showing a program for carrying out an abnormality-determining process according to the first embodiment.
Figure 3:
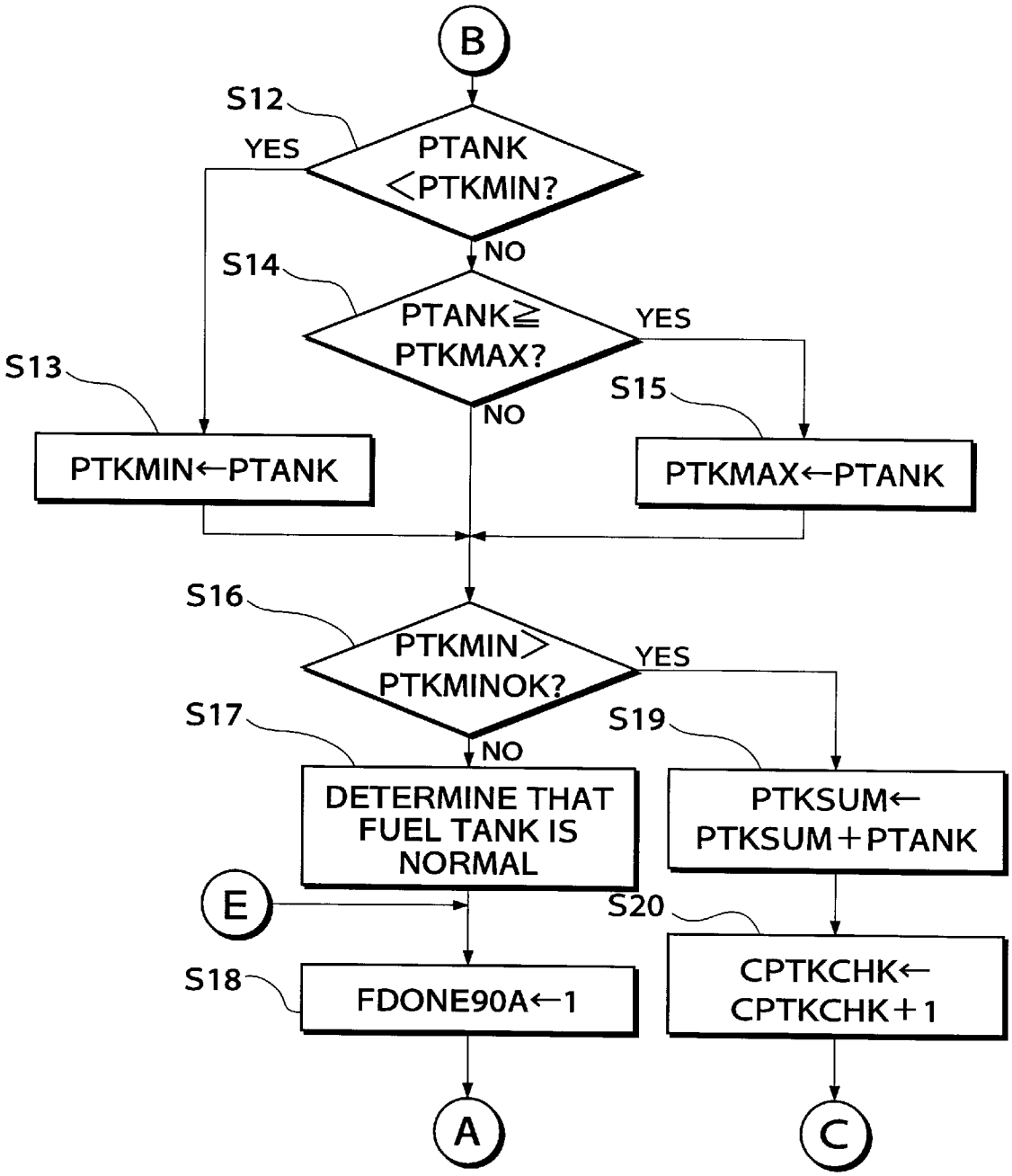
FIG. 3 is a continued part of the flowchart of FIG. 2.
Figure 4:
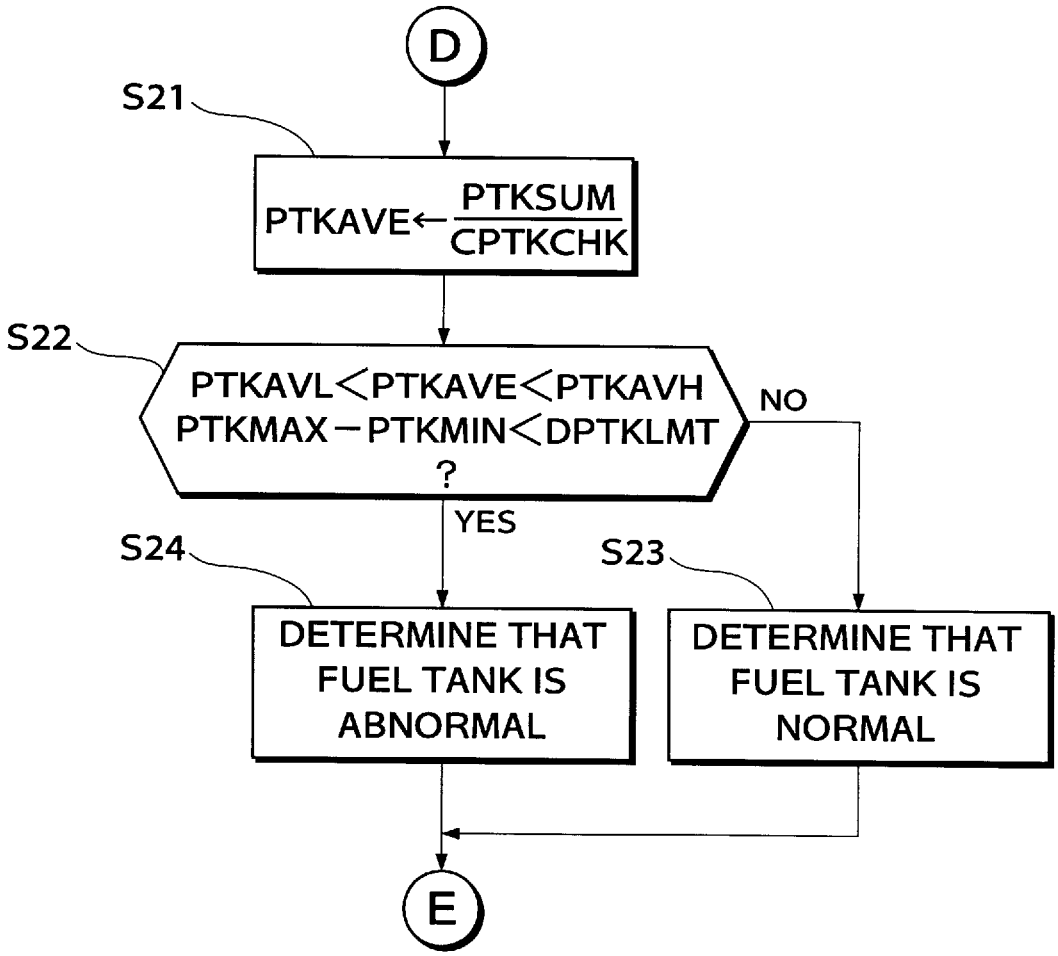
FIG. 4 is a continued part of the flowchart of FIG. 3.

FIGS. 2 to 4 show an abnormality-determining process according to the first embodiment of the invention.

First, at a step S1, it is determined whether or not an abnormality determination completion flag FDONE90A assumes "1". The abnormality determination completion flag FDONE90A, when set to "1", indicates that the abnormality-determining process has been completed. When this question is first made, the answer is negative (NO), and then the program proceeds to a step S2, wherein it is determined whether or not the engine 1 is in starting mode.

If the answer is affirmative (YES), the temperature TW of the engine coolant detected by the TW sensor 15 is stored as a starting mode engine coolant temperature TWINI at a step S3, and a timer tmPTKAST for counting a predetermined time period T1 after shifting from the starting mode to normal operation mode is set to the time period T1 at a step S4. Then, at a step S5, a present value of the tank internal pressure PTANK is stored as a maximum value PTKMAX and a minimum value PTKMIN of the tank internal pressure PTANK, and a sum value PTKSUM of the PTANK values and the count value of a counter CPTKCHK for counting the number of times of monitoring of the PTANK value, i.e. a number N of times of sampling of the PTANK value, are set to "0". At the same time, the number N of times of sampling to be carried out is calculated depending on the starting mode engine coolant temperature TWINI stored at the step S3.

Figure 6:
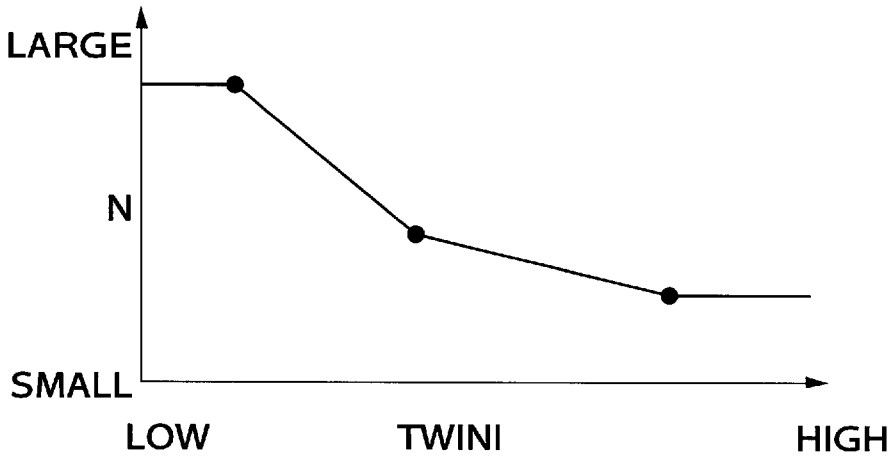
FIG. 6 shows a table for determining a number N of times of sampling of the tank internal pressure PTANK.

The calculation of the number N of times of sampling at the step S5 is executed by using a table, e.g. shown in FIG. 6 stored in the memory circuit of the ECU 5, beforehand. In the figure, the number N is set to a larger value as the starting mode engine coolant temperature TWINI is lower (e.g. the number N is set to 180 when the starting mode engine coolant temperature TWINI assumes 20° C., while it is set to 360 when the starting mode engine coolant temperature TWINI assumes 0° C.). The above setting can bring the following advantage: That is, when no leakage from the fuel tank 9 exists, even in an environment in which the change in the tank internal pressure PTANK is small, such as when the starting mode engine coolant temperature TWINI is low, the change in the tank internal pressure PTANK can be positively detected by increasing the number N of times of sampling of the PTANK value, i.e. prolonging the sampling time period.

Referring again to FIG. 2, at a step S6, a present value of the tank internal pressure PTANK is set as a reference value PTKBF for calculating an amount of change in the PTANK value, and a timer tmPTKCHK for setting time intervals of sampling of the PTANK value is set to a predetermined value T2, followed by terminating the present routine.

On the other hand, if the answer to the question of the step S2 is negative (NO), i.e. if the engine 1 has shifted from the starting mode to the normal operation mode, it is determined at a step S7 whether or not the count value of the timer tmPTKAST is equal to "0".

If the answer is negative (NO), it is determined that the predetermined time period T1 has not elapsed after the shift from the starting mode to the normal operation mode, and then the program proceeds to the step S5. On the other hand, if the answer to the question of the step S7 is affirmative (YES), it is determined at a step S8 whether or not the count value of the timer tmPTKCHK set at the step S6 is equal to "0". If the answer is negative (NO), the present routine is terminated.

On the other hand, if the answer is affirmative (YES), a present value of the tank internal pressure PTANK is fetched at a step S9, and it is determined at a step S10 whether or not the absolute value of the difference between the PTANK value and the reference value PTKBF is larger than a predetermined threshold value DPTKCHK. If the answer is affirmative (YES), it is determined that the change in the PTANK value is too large to be employed for using the PTANK value in the determination of abnormality of the emission control system. Therefore, the steps S5 and S6 are executed again.

If the answer to the question of the step S10 is negative (NO), it is determined that the change in the PTANK value is not so large that the PTANK value is suitable for use in determining abnormality of the emission control system, and then the program proceeds to a step S11 et seq.

By executing the steps S1, S2, and S7 to S10, only when the change in the tank internal pressure PTANK is not so large, the PTANK value is read in at the predetermined time intervals T2 set by the timer tmPTKCHK, and the abnormality determination is carried out based on the thus read PTANK value.

At the step S11, it is determined whether or not the count value of the counter CPTKCHK is equal to the number N of times of sampling set at the step S5. When this question is first made, the answer is negative (NO), and then the program proceeds to a step S12. At the step S12, it is determined whether or not the present value of the tank internal pressure PTANK is smaller than the minimum value PTKMIN, and if the answer is affirmative (YES), the minimum value PTKMIN is updated to the present value PTANK at the step S13, followed by the program proceeding to a step S16. On the other hand, if the answer to the question of the step S12 is negative (NO), it is determined at a step S14 whether or not the present value PTANK is equal to or larger than the maximum value PTKMAX. If the answer is affirmative (YES), the maximum value PTKMAX is updated to the present value PTANK at a step S15, followed by the program proceeding to the step S16.

At the step S16, it is determined whether or not the minimum value PTKMIN is larger than a predetermined value PTKMINOK (e.g. −5 mmHg). If the answer is negative (NO), it is determined at a step S17 that the fuel tank 9 does not suffer from leakage and therefore it is normal. Then, the abnormality determination completion flag FDONE90A is set to "1" at a step S18, and the steps S5 and S6 are executed again, followed by terminating the present routine.

The determination at the step S17 that there is no leakage from the fuel tank 9 when the minimum value PTKMIN of the tank internal pressure PTANK is smaller than the predetermined value PTKMINOK is based on the following experimentally obtained finding: That is, the pressure within the fuel tank 9 is controlled by the one-way valve 21 and the two-way valve 22, and therefore, if there is no leakage from the fuel tank 9, the pressure within the fuel tank becomes negative when evaporative fuel within the fuel tank 9 is cooled and liquefied. On the other hand, if there is leakage from the fuel tank 9, the pressure within the fuel tank cannot become lower than the atmospheric pressure.

Figure 5:
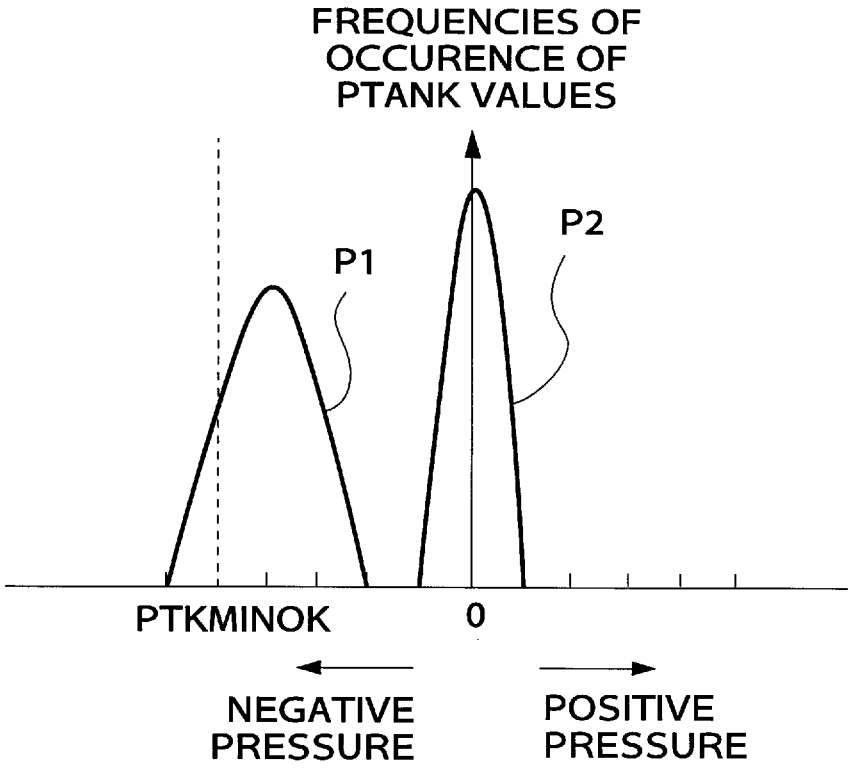
FIG. 5 is a graph showing frequencies of occurrence of values of tank internal pressure PTANK detected during execution of the abnormality-determining process.

More specifically, FIG. 5 shows frequencies of occurrence of values of the tank internal pressure PTANK detected during execution of the abnormality-determining process, as a result of a test conducted by the inventors. In the figure, the solid line P1 represents the frequencies of occurrence of PTANK values detected when the emission control system is normal, while the solid line P2 the frequencies of occurrence of PTANK values detected when the emission control system is abnormal. According to the result of FIG. 5, it can be determined that there is no leakage from the fuel tank 9 when the minimum value PTKMIN is lower than the predetermined value PTKMINOK.

Referring back to FIG. 3, if the answer to the question of the step S16 is affirmative (YES), it is determined that there is a possibility of leakage from the fuel tank 9, and then at a step S19, the PTANK value detected in the present loop is added to the sum value PTKSUM obtained up to the last loop, to thereby update the sum value PTKSUM at a step S19. Then, the count value of the counter CPTKCHK is incremented by 1 at a step S20, and then the step S6 is executed again, followed by terminating the present routine.

When the process described above is repeatedly carried out N times, the answer to the question of the step S11 becomes affirmative (YES). At this time, the total number of PTANK values sampled one by one at intervals of the predetermined time period T2 set by the timer tmPTKCHK becomes equal to N.

Then, at a step S21, the sum value PTKSUM of the tank internal pressure PTANK is divided by the number N of the PTANK values, i.e by the count value N of the counter CPTKCHK, to thereby calculate an average value PTKAVE of the tank internal pressure PTANK.

Then, it is determined at a step S22 whether or not the average value PTKAVE calculated at the step S21 falls within a range between a predetermined negative value PTKAVL (e.g. −5 mmHg) and a predetermined positive value PTKAVH (e.g. 5 mmHg) and at the same time the difference between the maximum value PTKMAX of the tank internal pressure PTANK and the minimum value PTKMIN of the same is smaller than a predetermined value DPTKLMT (e.g. 3 mmHg). If the answer is negative (NO), it is determined at a step S23 that the tank internal pressure PTANK has changed and therefore the fuel tank 9 does not suffer from leakage, that is, it is normal. Then, the step S18 et seq. are repeatedly executed.

On the other hand, if the answer to the question of the step S22 is affirmative (YES), which means that the tank internal pressure PTANK has remained equal or close to the atmospheric pressure, as indicated by the solid line P2 in FIG. 5, it is determined at a step S24 that the fuel tank 9 is abnormal. Then, the program proceeds to the step S18, wherein the abnormality determination completion flag FDONE90A is set to "1", and then the steps S5 and S6 are executed again, followed by terminating the present routine.

As described hereinabove, according to the present embodiment, when the starting mode engine coolant temperature TWINI is low, the time period over which the change in the tank internal pressure PTANK is monitored is set to a longer time period than when the temperature TWINI is high, by setting the number N of times of sampling to a larger value. As a result, even in an environment in which the change in the tank internal pressure PTANK is small, such as when the engine coolant temperature TW is low at the start of the engine, if the fuel tank 9 is normal, a sufficient amount of change in the tank internal pressure can be obtained, to thereby prevent erroneous detection of abnormality, such as leakage from the emission control system.

In the present embodiment, as a parameter for detecting a low temperature state of the fuel tank in which the change in the tank internal pressure is small, the engine coolant temperature TW is employed, which, however, is not limitative. Alternatively, an output value from a sensor for detecting the ambient temperature of the engine, e.g. an output value from the intake air temperature sensor 14, an outside air temperature sensor, not shown, or a fuel temperature sensor, not shown, may be employed in place of the output value from the engine coolant temperature sensor 15.

Next, description will made of second and third embodiments of the invention. The hardware construction shown in FIG. 1 can also apply to the second and third embodiments.

First, the second embodiment of the invention will be described with reference to FIGS. 7 to 11.

Figure 7:
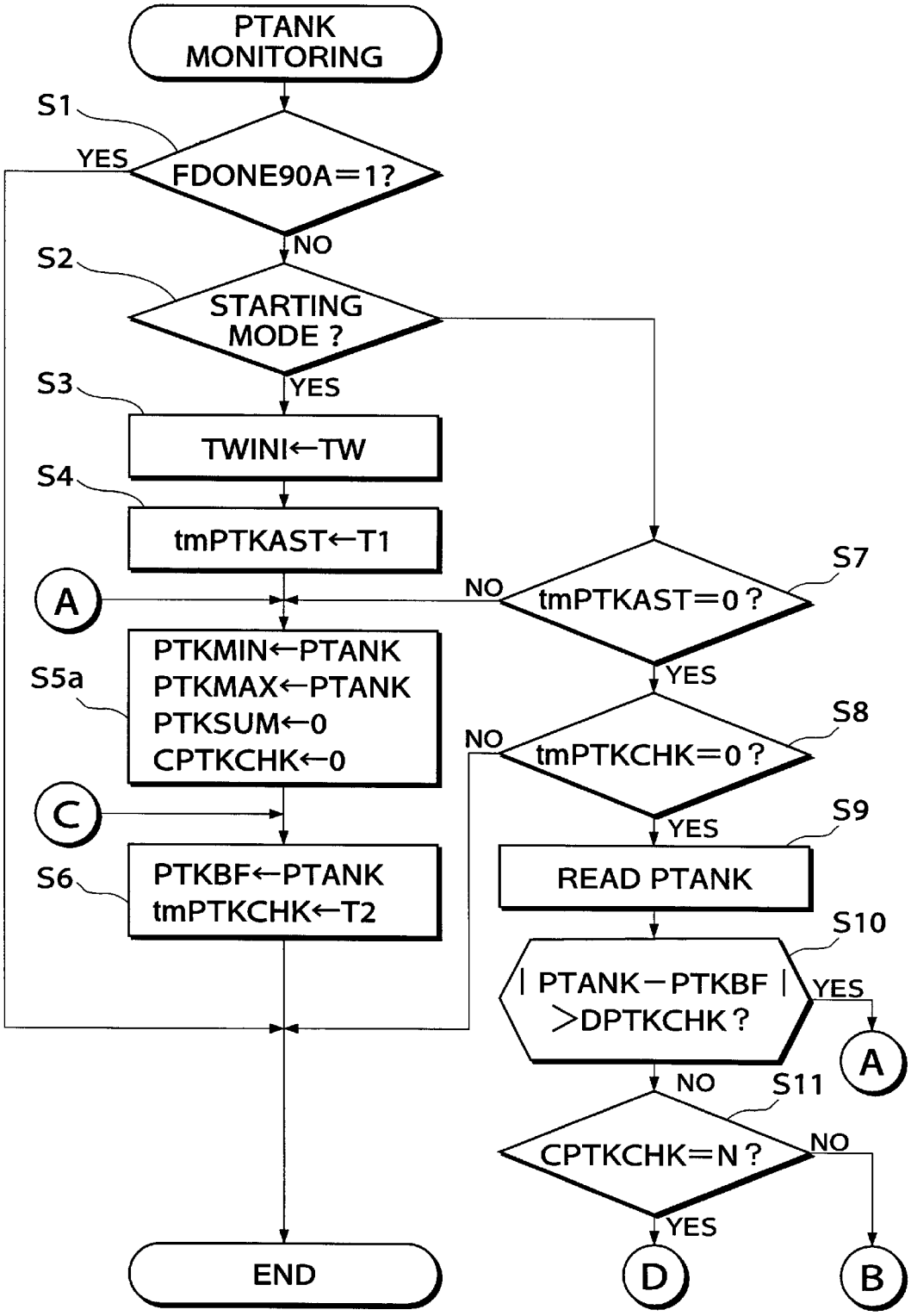
FIG. 7 is a part of a flowchart showing a program for carrying out an abnormality-determining process according to a second embodiment of the invention, which corresponds to the FIG. 2 flowchart of the first embodiment.
Figure 8:
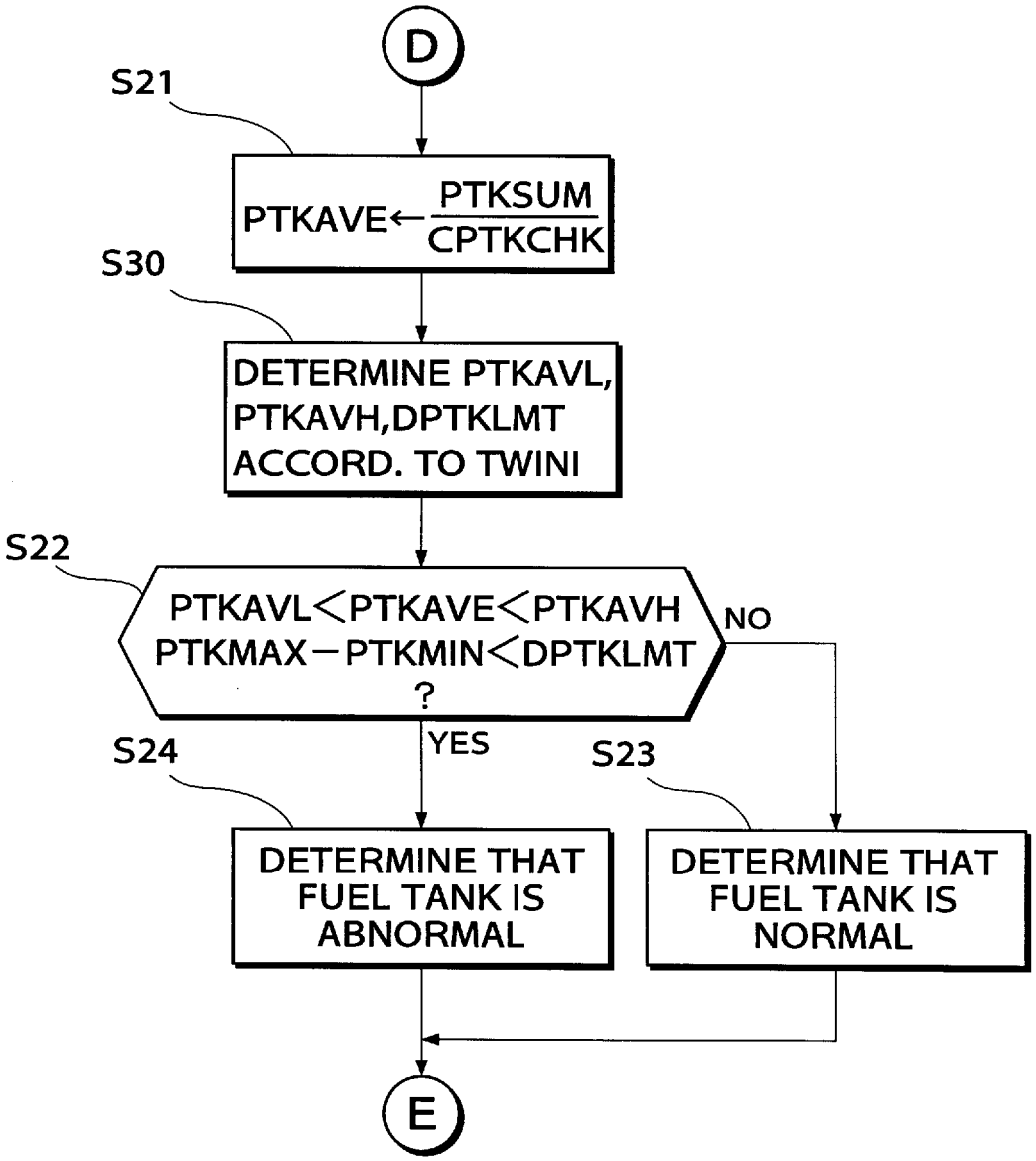
FIG. 8 is a continued part of the flowchart of FIG. 3, according to the second embodiment, which corresponds to the FIG. 4 flowchart of the first embodiment.

FIGS. 7 and 8 as well as FIG. 3 of the first embodiment show a program for carrying out an abnormality determining-process according to the second embodiment. That is, the abnormality determining-process according to the second embodiment is identical with the abnormality determining-process of FIGS. 2 to 4 in the first embodiment described above, except for a step S5*a* in FIG. 7 and a step S30 in FIG. 8. Therefore, FIG. 3 of the first embodiment can apply also in the second embodiment. Description will be made of these steps S5*a* and S30 alone.

In FIG. 7, after execution of the step S4, the program proceeds to the step S5*a*, wherein a present value of the tank internal pressure PTANK is stored as the maximum value PTKMAX and the minimum value PTKMIN of the tank internal pressure PTANK, and the sum value PTKSUM of PTANK values and the count value of the counter CPTKCHK for counting the number of times of sampling of the PTANK value are set to "0". Then, the program proceeds to the step S6 et seq.

In FIG. 8, after execution of the step S21, the program proceeds to the step S30, wherein the threshold values for determining abnormality, i.e. the predetermined negative value PTKAVL, the predetermined positive value PTKAVH, and the predetermined value DPTKLMT, are determined according to the starting mode engine coolant temperature TWINI. Then, the program proceeds to the step S22 et seq.

Figure 9:
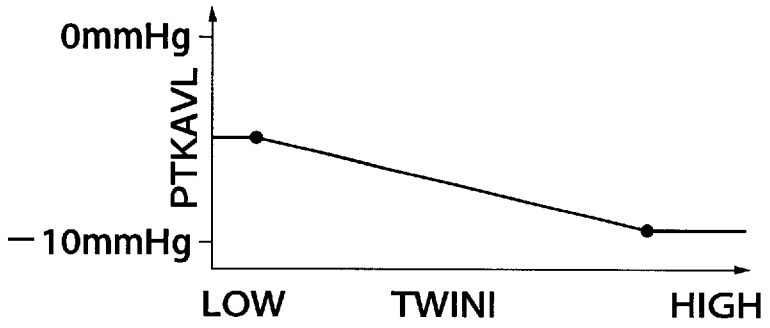
FIG. 9 shows a table for determining a predetermined negative value PTKAVL which is employed in the process of FIG. 8.
Figure 10:
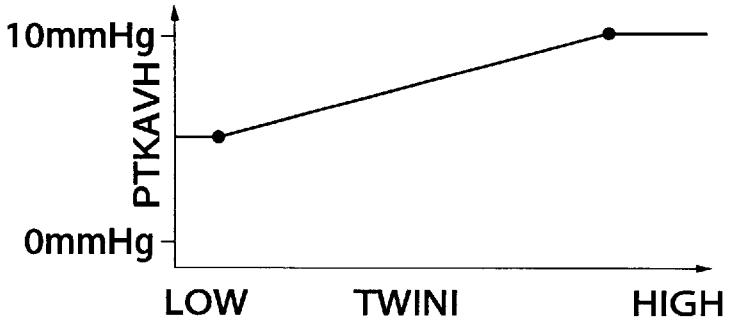
FIG. 10 shows a table for determining a predetermined positive value PTKAVH which is employed in the process of FIG. 8.
Figure 11:
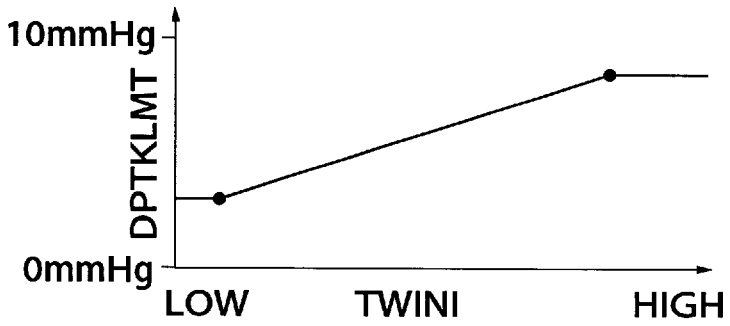
FIG. 11 shows a table for determining a predetermined value DPTKLMT which is employed in the process of FIG. 8.

In the present embodiment, the predetermined negative value PTKAVL, the predetermined positive value PTKAVH, and the predetermined value DPTKLMT are determined from respective tables, e.g. shown in FIGS. 9, 10, and 11, which are stored in the ECU 5 beforehand. As shown in FIG. 9, the predetermined negative value PTKAVL is set to a larger value as the starting mode engine coolant temperature TWINI is lower. As shown in FIG. 10, the predetermined positive value PTKAVH is set to a smaller value as the starting mode engine coolant temperature TWINI is lower. Further, as shown in FIG. 11, the predetermined value DPTKLMT is set to a smaller value as the starting mode engine coolant temperature TWINI is lower.

Thus, according to the second embodiment, the predetermined negative value PTKAVL, the predetermined positive value PTKAVH, and the predetermined value DPTKLMT are determined according to the starting mode engine coolant temperature TWINI. As a result, even in an environment in which the change in the tank internal pressure PTANK is relatively small, such as when the starting mode engine coolant temperature TWINI is low, if the fuel tank is normal, a sufficient amount of change in the tank internal pressure can be obtained, to thereby prevent erroneous detection of abnormality, such as leakage from the emission control system.

Alternatively, by combining the first and second embodiments, the time period over which the change in the tank internal pressure PTANK is monitored, and the abnormality-determining threshold values may be both changed according to the starting mode engine coolant temperature TWINI.

Further, also in the second embodiment, as a parameter for detecting a low temperature state of the fuel tank in which the change in the tank internal pressure is small, an output value from a sensor for detecting the ambient temperature of the engine, e.g. the output value from the intake air temperature sensor 14, the outside air temperature sensor, or the fuel temperature sensor may be employed in place of output value from the engine coolant temperature sensor 15.

Next, the third embodiment of the invention will be described with reference to FIG. 12.

Figure 12:
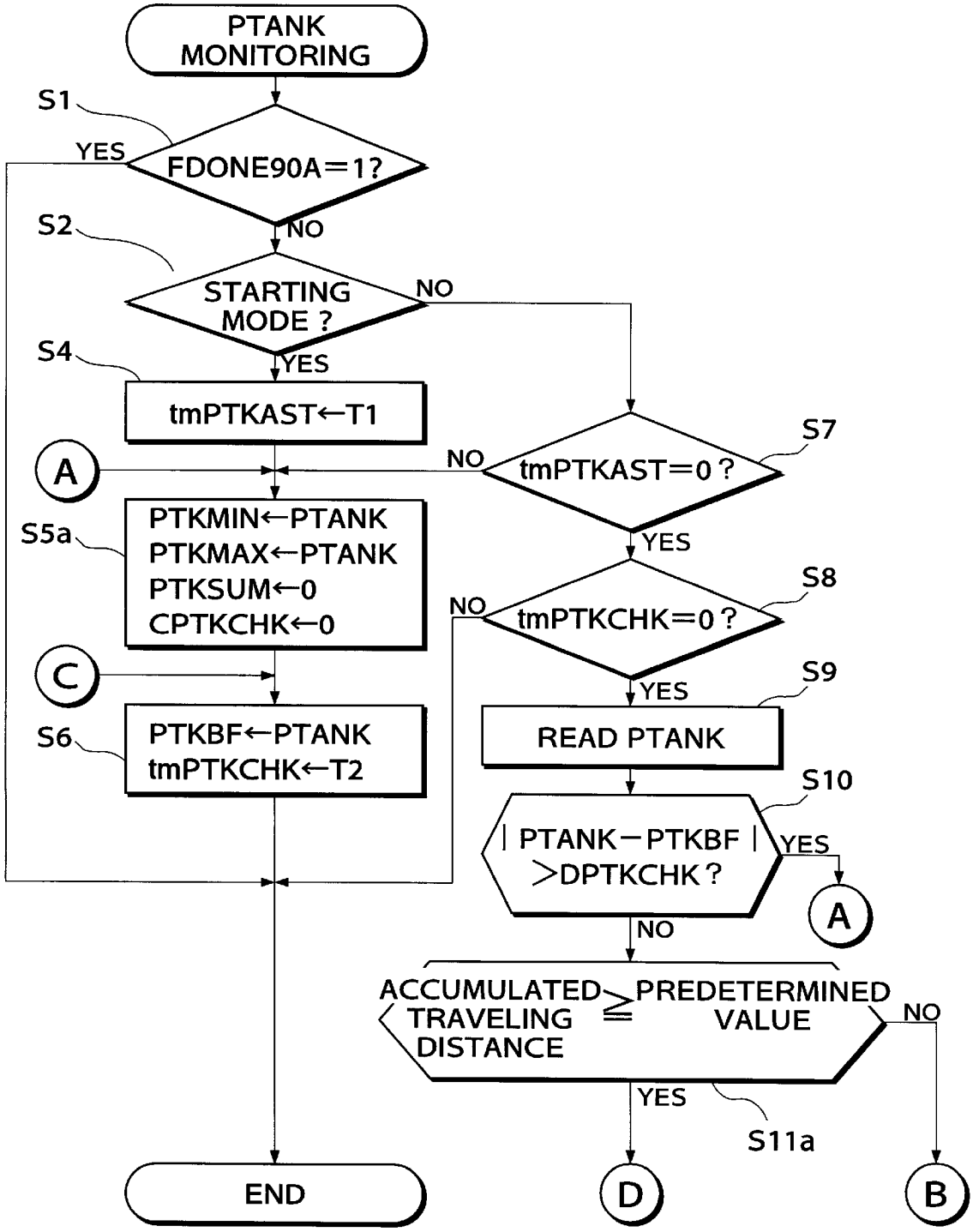
FIG. 12 is a part of a flowchart showing a program for carrying out an abnormality-determining process according to a third embodiment of the invention, which corresponds to the FIG. 2 flowchart of the first embodiment.

FIGS. 12 as well as FIGS. 3 and 4 of the first embodiment show a program for carrying out an abnormality-determining process according to the third embodiment. The program of FIG. 12 is identical with the program of FIG. 7 of the second embodiment, except for omission of the step S3 and addition of a step S11*a* in place of the step S11 in FIG. 7. FIGS. 3 and 4 of the first embodiment can also apply in the third embodiment. Therefore, description will be made of these changed steps alone.

In FIG. 12, if the answer to the question of the step S2 is affirmative (YES), the timer tmPTKAST is set to the predetermined time period T1 at the step S4, and then the program proceeds to the step S5*a*. The steps S5*a* to S10 are executed in the same manner as in the second embodiment.

If the answer to the question of the step S10 is negative (NO), the program proceeds to a step S11*a*, wherein it is determined whether or not an accumulated value of the traveling distance of the vehicle after the engine has been started is larger than a predetermined value.

If the answer is negative (NO), i.e. if the accumulated traveling distance value of the vehicle is below the predetermined value, the program proceeds to the step S12 of FIG. 3.

On the other hand, if the answer is affirmative (YES), i.e. if it is determined that the accumulated traveling distance value is equal to or larger than the predetermined value, it means that the vehicle has traveled over a sufficient distance after the start of the engine. Then, the program proceeds to the step S21 of FIG. 4, wherein the abnormality determination for the emission control system is executed.

The reason why the abnormality determination is executed when the accumulated traveling distance value of the vehicle exceeds the predetermined value is that the abnormality determination should be executed under a condition in which the temperature within the fuel tank has risen to such a sufficient level that the tank internal pressure PTANK has changed by a sufficient amount.

As described hereinabove, according to the third embodiment of the invention, the timing for executing the abnormality determination of the emission control system is set not based on the time lapse from the start of the engine but based on the accumulated traveling distance. As a result, even when the engine is idling or operating under a low load condition in an environment of low outside air temperature, if the fuel tank is normal, a sufficient amount of change in the tank internal pressure can be detected, to thereby prevent erroneous detection of abnormality in the emission control system.

In the present embodiment, alternatively, an accumulated purging flow rate may be calculated in place of the calculation of the accumulated traveling distance of the vehicle, and the abnormality determination of the emission control system may be executed when the accumulated purging flow rate obtained after the engine has been started exceeds a predetermined value.

Alternatively, the process in the third embodiment may be combined with the process in the first embodiment or the second embodiment.

What is claimed is:

1. In an evaporative fuel-processing system for an internal combustion engine having a fuel tank, said engine being installed in a vehicle, said evaporative fuel-processing system including an evaporative emission control system having a canister for adsorbing evaporative fuel generated in said fuel tank, a passage extending between said fuel tank and said canister, a pressure-regulating valve arranged across said passage, for regulating pressure within said fuel tank to a predetermined value, and pressure-detecting means for detecting pressure within said fuel tank, and abnormality-determining means for determining whether said evaporative emission control system is abnormal, based on said pressure within said fuel tank detected by said pressure-detecting means over a predetermined time period after starting of said engine, the improvement wherein:

said abnormality-determining means executes abnormality determination of said evaporative emission control system when a traveling distance of said vehicle assumed after starting of said engine exceeds a predetermined value.

2. In an evaporative fuel-processing system for an internal combustion engine having a fuel tank, including an evaporative emission control system having a canister for adsorbing evaporative fuel generated in said fuel tank, a passage extending between said fuel tank and said canister, a pressure-regulating valve arranged across said passage, for regulating pressure within said fuel tank to a predetermined value, and pressure-detecting means for detecting pressure within said fuel tank, and abnormality-determining means for determining whether said evaporative emission control system is abnormal, based on said pressure within said fuel tank detected by said pressure-detecting means over a predetermined time period after starting of said engine, the improvement wherein:

said abnormality-determining means determines whether said evaporative emission control system is abnormal, by comparing a value corresponding to said pressure within said fuel tank detected by said pressure-detecting means, with a predetermined reference value set based on a parameter representative of temperature of said fuel tanks;

said abnormality-determining means determines that said evaporative emission control system is abnormal when an average value of said detected pressure within said fuel tank falls within a range between a predetermined negative pressure value and a predetermined positive pressure value and at the same time a difference between a maximum value and a minimum value of said detected pressure within said fuel tank is smaller than a predetermined value;

said predetermined negative pressure value is set to a larger value as said parameter indicates a lower value of said temperature of said fuel tank; and wherein said predetermined positive pressure value is set to a smaller value as said parameter indicates a lower value of said temperature of said fuel tank.

3. An evaporative fuel-processing system as claimed in claim 2, wherein said parameter is representative of temperature of said engine.

4. An evaporative fuel-processing system as claimed in claim 2, wherein said parameter is representative of ambient temperature of said engine.

5. An evaporative fuel-processing system as claimed in claim 2, wherein said difference is set to a larger value as said parameter indicates a lower value of said temperature of said fuel tank.

* * * * *